US009993825B2

(12) United States Patent
Pallmann

(10) Patent No.: US 9,993,825 B2
(45) Date of Patent: Jun. 12, 2018

(54) DEVICE FOR COMMINUTING FEEDSTOCK

(71) Applicant: PALLMANN MASCHINENFABRIK GmbH & Co. KG, Zweibruecken (DE)

(72) Inventor: Hartmut Pallmann, Zweibruecken (DE)

(73) Assignee: PALLMANN MASCHINENFABRIK GmbH & Co. KG, Zweibruecken (DE)

( * ) Notice: Subject to any disclaimer, the term of this patent is extended or adjusted under 35 U.S.C. 154(b) by 407 days.

(21) Appl. No.: 14/252,022

(22) Filed: Apr. 14, 2014

(65) Prior Publication Data

US 2014/0306046 A1 Oct. 16, 2014

(30) Foreign Application Priority Data

Apr. 13, 2013 (DE) ..... 10 2013 006 405

(51) Int. Cl.

| | |
|---|---|
| ***B02C 18/16*** | (2006.01) |
| ***B02C 18/14*** | (2006.01) |
| ***B02C 23/16*** | (2006.01) |
| ***B02C 17/18*** | (2006.01) |

(52) U.S. Cl.

CPC ..... *B02C 18/16* (2013.01); *B02C 17/1855* (2013.01); *B02C 18/14* (2013.01); *B02C 23/16* (2013.01); *B02C 2018/162* (2013.01)

(58) Field of Classification Search

CPC ... B02C 17/1855; B02C 18/14; B02C 18/141; B02C 18/142; B02C 18/143; B02C 18/144; B02C 18/145; B02C 18/146; B02C 18/16; B02C 18/18; B02C 2018/162; B02C 2018/188; B02C 23/10; B02C 23/16

USPC ..... 241/73, 79, 89.3, 242, 243

See application file for complete search history.

(56) References Cited

U.S. PATENT DOCUMENTS

| | | | | |
|---|---|---|---|---|
| 2,360,357 | A * | 10/1944 | Marshall | B02C 18/146 241/285.2 |
| 2,694,492 | A * | 11/1954 | Rumpf et al. | B07B 7/083 209/147 |
| 3,237,873 | A * | 3/1966 | Raski | B02C 13/00 241/239 |
| 3,311,310 | A | 3/1967 | Engels et al. | |
| 4,382,557 | A * | 5/1983 | Duerr | B02C 17/16 241/1 |

(Continued)

FOREIGN PATENT DOCUMENTS

DE 1 482 391 B1 8/1970

*Primary Examiner* — Shelley Self
*Assistant Examiner* — Gregory Swiatocha
(74) *Attorney, Agent, or Firm* — Muncy, Geissler, Olds & Lowe, P.C.

(57) ABSTRACT

A device for comminuting feedstock with a rotor which is disposed within a housing and rotates about an axis of rotation and is equipped over its circumference with comminuting tools. A ring disc is attached to front sides of the rotor in each case concentrically to the axis of rotation. The removal of the sufficiently comminuted material occurs via a screen deck extending over part of the rotor circumference. On axial front sides of the screen deck an arcuate sealing element following the outer circumference of the ring disc is disposed in each case, the element which to form a sealing gap in the plane of the ring disc lies radially opposite to the disc. The sealing effect of the sealing gap between the screen deck and rotor uniformly over the entire length is successfully achieved in this way.

15 Claims, 5 Drawing Sheets

(56) References Cited

U.S. PATENT DOCUMENTS

| | | | | |
|---|---|---|---|---|
| 2006/0118671 | A1* | 6/2006 | Astafan | B02C 18/141<br>241/242 |
| 2012/0061498 | A1* | 3/2012 | Pallmann | B02C 18/144<br>241/73 |

* cited by examiner

DEVICE FOR COMMINUTING FEEDSTOCK

This nonprovisional application claims priority under 35 U.S.C. § 119(a) to German Patent Application No. DE 10 2013 006 405.8, which was filed in Germany on Apr. 13, 2013, and which is herein incorporated by reference.

BACKGROUND OF THE INVENTION

Field of the Invention

The invention relates to a device for comminuting feedstock.

Description of the Background Art

Such devices fall within the field of mechanical process engineering, particularly the comminution of feedstock by means of cutting, shearing, tearing, or breaking up. But the breaking of the bond of composite materials, with which a comminution of the feedstock always proceeds, is also within the scope of the present invention. Within the meaning of the invention, prior-art devices are, for example, shredders, cutting mills, hammer mills, and the like. Generic devices therefore are suitable for comminuting piece and bulk goods, particularly plastics with and without admixtures, wood, scrap wood, paper, cardboard, cellulose, textiles, waste materials, rubber, natural rubber, resins, leather, foodstuffs, semi-luxury food, and feedstuffs, minerals, pigments, dyes, pharmaceuticals, metals, composite materials such as electronic waste, cables, used tires, and the like. Other feedstock originates from the recovery of reusable materials during recycling, for example, for their reuse as alternative fuels.

The basic principle of material processing results from the interaction of rotating cutting, shearing, or tearing tools with stationary tools or, however, from the impact energy of rapidly rotating impact tools such as hammers, plates, and the like, which break up the feedstock. After sufficient comminution, the feedstock is removed from the device via a screen deck, whereby the screen deck can function in addition as a comminution tool. The screen therefore divides the housing interior functionally into an upstream comminution region and a downstream comminution region for the removal of already comminuted material.

US 200600118671 A1 discloses a generic device having a rotor-accommodating housing. The rotor is formed by a drive shaft on which a plurality of rotor discs sit concentrically. The rotor discs are equipped over their circumference with tooth-like comminuting tools and act together with stator tools disposed in a stationary manner in the housing. A wear ring is disposed concentrically to the drive shaft in each case on the front rotor discs of the rotor. The rotor penetrates the housing in the axial direction, to which end the housing walls have circular openings. The rotor is mounted in bearings outside the housing.

A screen deck, having screen supports and a perforated screen, extends over the rotor circumferential section running below the drive shaft, whereby the perforated screen while maintaining a radial distance follows the outer circumference of the two wear rings, so that a sealing gap through which accordingly small particles in the feedstock can leave the housing results between the perforated screen and wear rings.

Because the partially cylindrical shape of the perforated screen is produced by rolling, production-related tolerances result with respect to the curvature of the perforated screen. Subsequently, the perforated screen and the wear ring do not run constantly parallel to one another, but the radial width of the sealing gap varies over the circumference of the perforated screen. In areas where the sealing gap is wider, a negative effect on the sealing action therefore cannot be prevented. A further disadvantage is that because of the design type the gap always aligns axially with the inner circumference of the perforated screen. The operator of such a device is therefore restricted to this machine geometry.

SUMMARY OF THE INVENTION

It is therefore an object of the present invention to provide a device in such a way that a sealing action of a sealing gap between a screen deck and rotor is uniform over the entire length. A further object is that the type of material processing can be adapted to the feedstock by suitable structural measures in the area of the sealing gap.

In an embodiment, an advantage of the invention emerges from the possibility of not having to produce an arcuate sealing element of the invention, in contrast to perforated screens, by rolling, but by cutting, rotating, or milling from a plate. These types of machining enable very high precision in the fabrication of the sealing element edge facing the rotor, as a result of which the necessary curvature is maintained precisely over the entire length of the sealing element. The sealing gap formed with the rotor therefore has a uniform radial width over its entire length, with the result that the sealing effect of the sealing gap is constant over its length.

Moreover, the parts for forming the sealing gap are functionally decoupled from the parts for forming the screen deck by the provision of an arcuate sealing element on the front side of the screen deck. This opens the possibility to be able to adjust the relative position of the sealing gap in regard to the perforated screen by selecting suitable radii of the ring discs and sealing elements with respect to the rotor axis. In a first embodiment, the radius and thereby the curvature of the sealing element correspond to that of the perforated screen, which results in a radial position of the sealing gap at the level of the inner circumference of the perforated screen, at which the sealing gap aligns with the perforated screen, therefore in the axial direction. This embodiment is suitable in a particular way for feedstock with fibers or wires, which can pass the sealing gap relatively well, whereas larger particles in the feedstock such as, for example, rubber granules are removed via the screen deck. A preferred field of application of this embodiment is the recycling of old tires in which both the steel and rubber fractions are recovered.

If, in contrast, smaller radii of the sealing element and ring discs are selected or their curvatures are selected as greater than that of the perforated screen, then a sealing gap position results which is offset in the radial direction toward the axis of rotation and in which the sealing element with its inner circumference, forming the sealing gap, projects radially over the inner circumference of the perforated screen. In this embodiment, the radial projection causes the accumulation of fine particles before these can pass axially through the sealing gap, so that a time delay of passage through the gap results. Preferably, composite materials are processed with this machine configuration.

In contrast, selection of a larger radius of the sealing elements or ring discs achieves that the sealing gap is offset outwardly in the radial direction. In this embodiment, the ring discs and the perforated screen overlap in the radial direction, which leads to the formation of a second radially directed sealing gap.

In this embodiment, therefore, an increased sealing effect and thereby a more difficult gap passage arise which is advantageous, for example, during the processing of film-like feedstock. Such embodiments are therefore particularly suitable for the processing of feedstock to alternative fuels.

The invention will be described subsequently in greater detail with use of an exemplary embodiment illustrated in the drawings, whereby other features and advantages of the invention will become apparent. The exemplary embodiment relates to the implementation of the invention in a shredder, without the invention being limited thereto. Rather, similarly constructed devices based on the same functional principle are within the scope of the invention, for example, cutting mills, drum shredders, impact mills, and the like.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
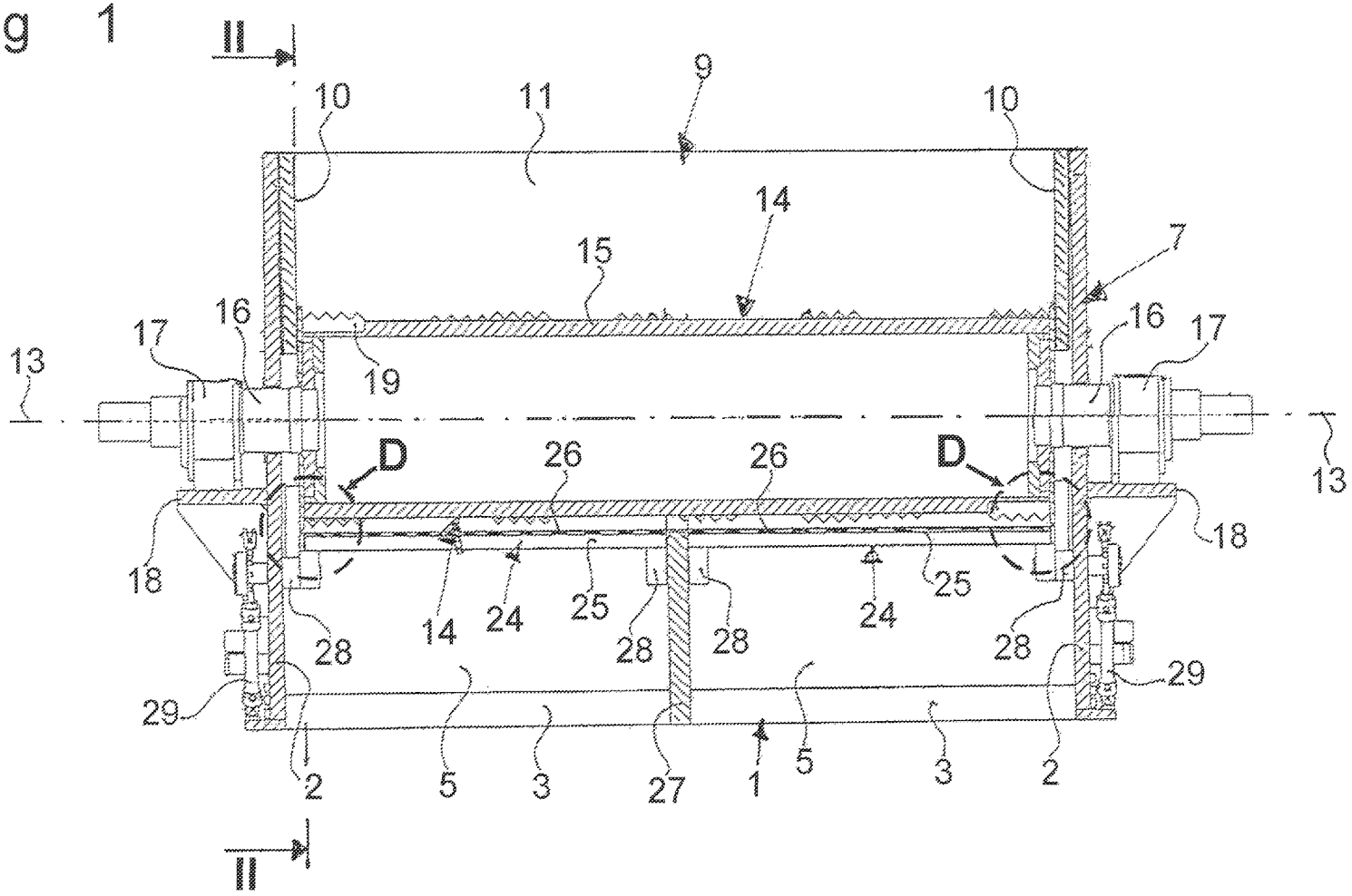
FIG. 1 is a longitudinal section through a device of the invention along the line I-I depicted in FIG. 2.
Figure 2:
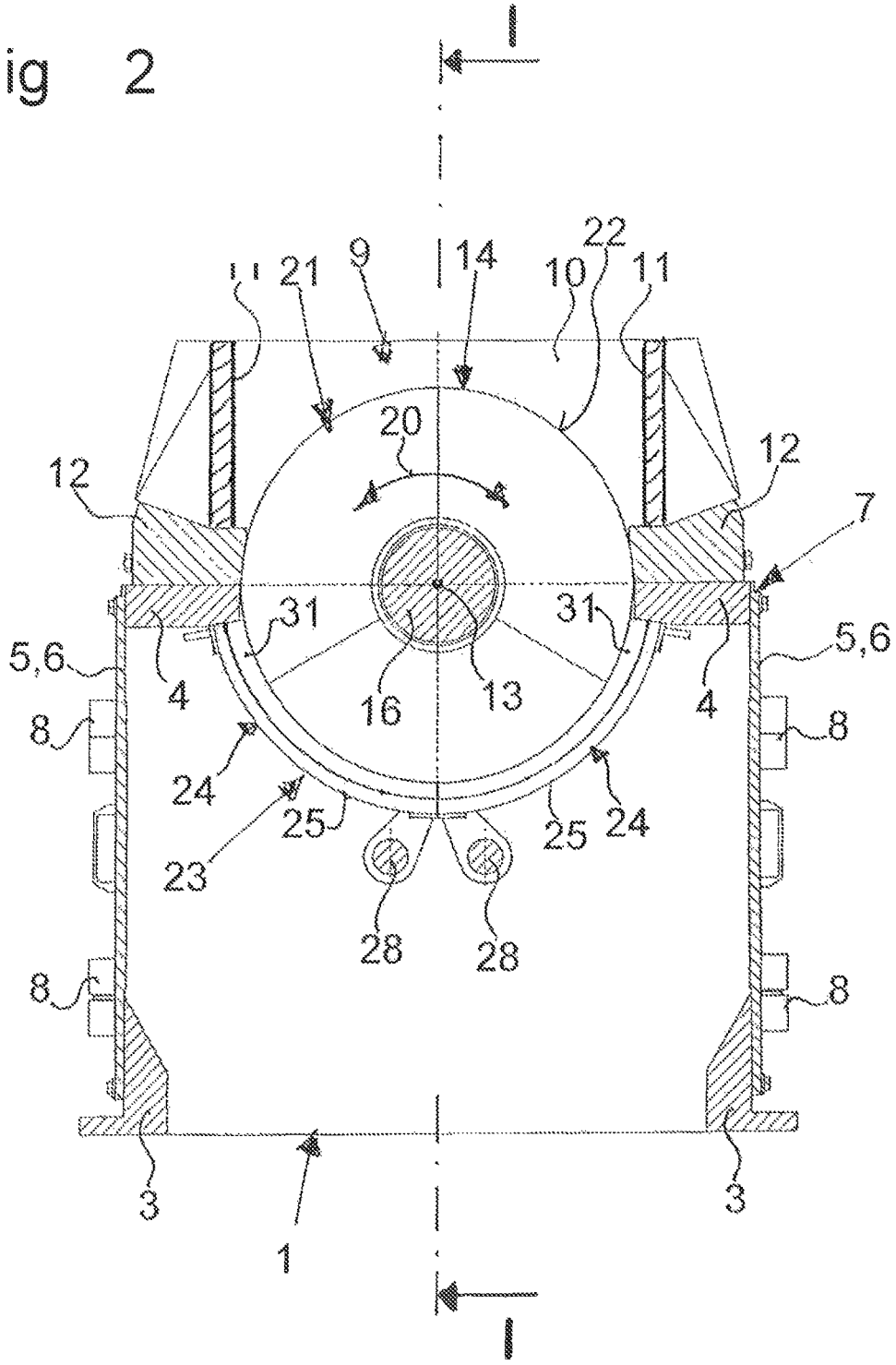
FIG. 2 is a cross section through the device depicted in FIG. 1 along the line II-II there.

FIGS. 1 and 2 show the general structure of a device of the invention. The device has a substantially symmetric structure, based on a machine base frame 1 with two cross walls 2 lying opposite at a distance plane parallel, which at their lower corners are connected rigidly to one another by lower longitudinal bars 3 and at their upper corners by upper longitudinal bars 4. Longitudinal walls 5, which connect cross walls 2, are formed over their entire surface area by doors 6, which can be pivoted on hinges 8 for opening and closing of housing 7, arising in this way, and thus assure accessibility to the interior of the device. A feed chute 9 with a rectangular cross section joins machine base frame 1 vertically upward; cross walls 10 of said chute represent the continuation of cross walls 2 of base frame 1 and its longitudinal walls 11 in the bottom area are formed in each case by a support beam 12 for receiving the stator knives. Feed chute 9 is open at the top, so that the feedstock via this opening enters the action zone of a rotor 14 disposed centrally in housing 7 and rotating about a longitudinal axis 13.

As emerges from FIGS. 1 and 2, rotor 14 is formed substantially by a rotor drum 15, in which in each case a shaft stub 16 engages rotationally fixed on the front side. The two shaft stubs 16 extend with their free ends through openings in cross walls 2, 10 and are mounted there rotatably outside housing 7 at an axial distance to cross walls 2, 10 in shaft bearings 17. To this end, brackets 18 are welded onto the outer sides of cross walls 2. Rotor 14 is equipped over its circumference with a plurality of rotor tools 19, which are spaced apart both in the circumferential direction and in the axial direction. Each rotor tool 19 is attached replaceably in a receptacle on the lateral surface of rotor drum 15. As indicated by arrow 20, rotor 14 can be operated in both rotation directions.

The front ends of rotor 14 are formed by ring discs 21 which are concentric to axis 13 and made up preferably of a plurality of sectors, such as, for example, three ring disc sectors with a circumferential section of 120° in each case, and are screwed together axially with the front rotor ends. The multipart design of ring discs 21 enables their assembly and disassembly without having to remove rotor 14 out of machine base frame 1. The outer diameter of ring discs 21 here is greater than the diameter of the cutting orbit. In FIG. 2, the outer diameter of ring discs 21 is labeled with the reference character 22.

The lower circumferential section of rotor 14 is surrounded by a screen deck 23, which in the present example is formed by four screen elements 24. Each screen element 24 has a screen support 25, on which a perforated screen 26 is mounted. In cross section, two screen elements 24 extend in a mirror image over approximately a fourth of the rotor circumference and in the longitudinal direction two screen elements 24 follow each other axially.

For the pivotable mounting of screen elements 24, axle bearings 28, in which screen supports 25 are mounted rotatably, are disposed on the inner side of cross wall 2 or on a partition wall 27. Screen elements 24 can be swung downward with the help of cylinder piston units 29 on the outer side of cross walls 2, whose movable pistons act via a control lever on screen support 24. In the case of open doors 6, therefore, access to perforated screens 26 and rotor 14 is assured.

By this type of structural design, longitudinal walls 11 of feed chute 9 together with screen deck 23 in processing terms form a separation of the upstream region, where the active material processing occurs, from the downstream region, which serves to remove the comminuted material from the device.

Figure 6:
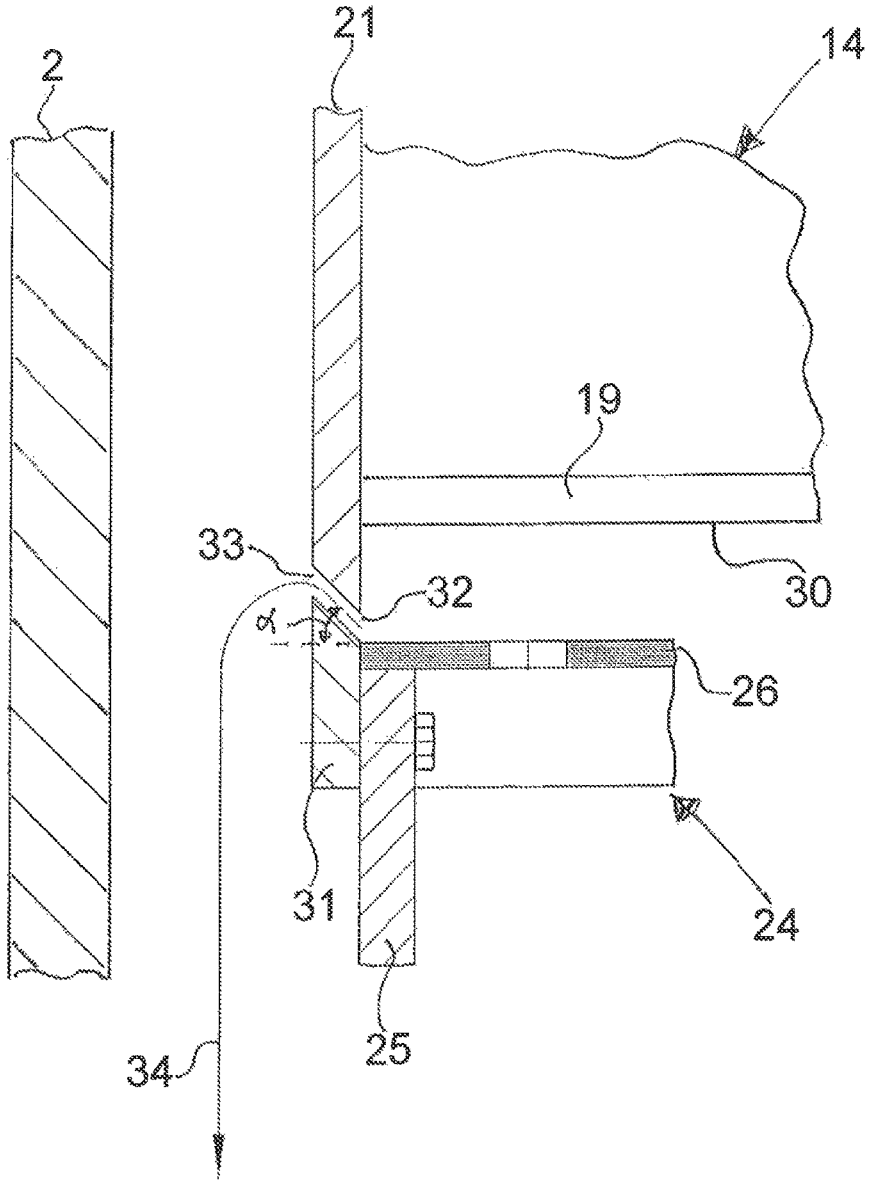
FIG. 6 illustrates a third alternative embodiment of the area labeled with D in FIG. 1.

The connection of rotating machine parts to stationary parts, particularly ring discs 21 of rotor 14 to screen deck 23, is of considerable importance in this context. On the one hand, it must be assured that feedstock not sufficiently comminuted does not enter the discharge zone of the device by bypassing screen deck 23; this presupposes a relatively narrow gap. On the other hand, the gap between rotating and stationary machine parts should not be so narrow that the rotational movement of rotor 14 is adversely impacted thereby or heat production and wear due to friction are too great. This region labeled with "D" in FIG. 1 is the subject matter of FIG. 3; alternative embodiments are shown in FIGS. 4 and 6.

Figure 3:
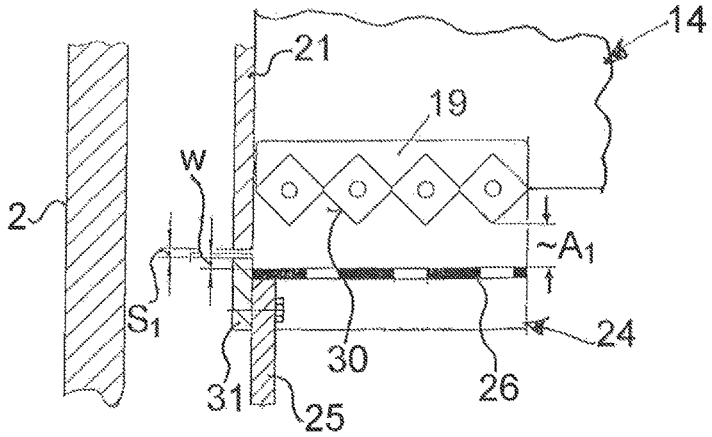
FIG. 3 illustrates the area labeled with D in FIG. 1 on a larger scale.
Figure 4:
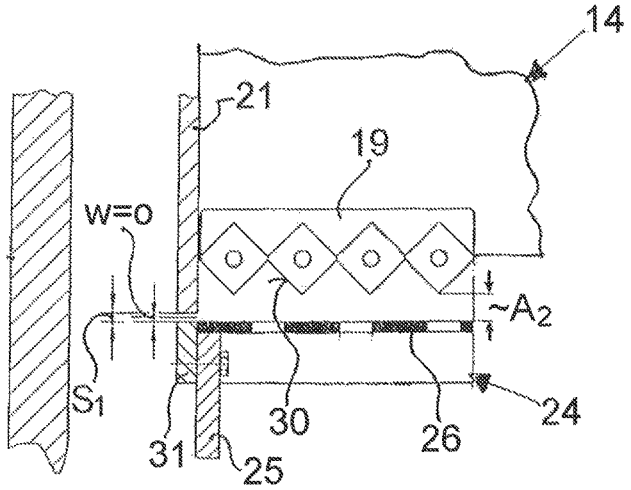
FIG. 4 illustrates a first alternative embodiment of the area labeled with D in FIG. 1.

In FIG. 3, the front bottom circumferential section of the rotor with a tooth-like rotor tool 19 can be seen whose active edge is labeled with the reference character 30. The maximum radial distance $A_1$ between rotor tools 19 and perforated screen 26 is between 15 mm and 35 mm. In the axial direction, the already mentioned ring disc 21, made up of three identical ring disc sectors, forms the rotor end plate. Cross wall 2 of housing 7 runs in the clear axial distance of, for example, at least 3 cm or at least 5 cm to ring disc 21.

Figure 7:
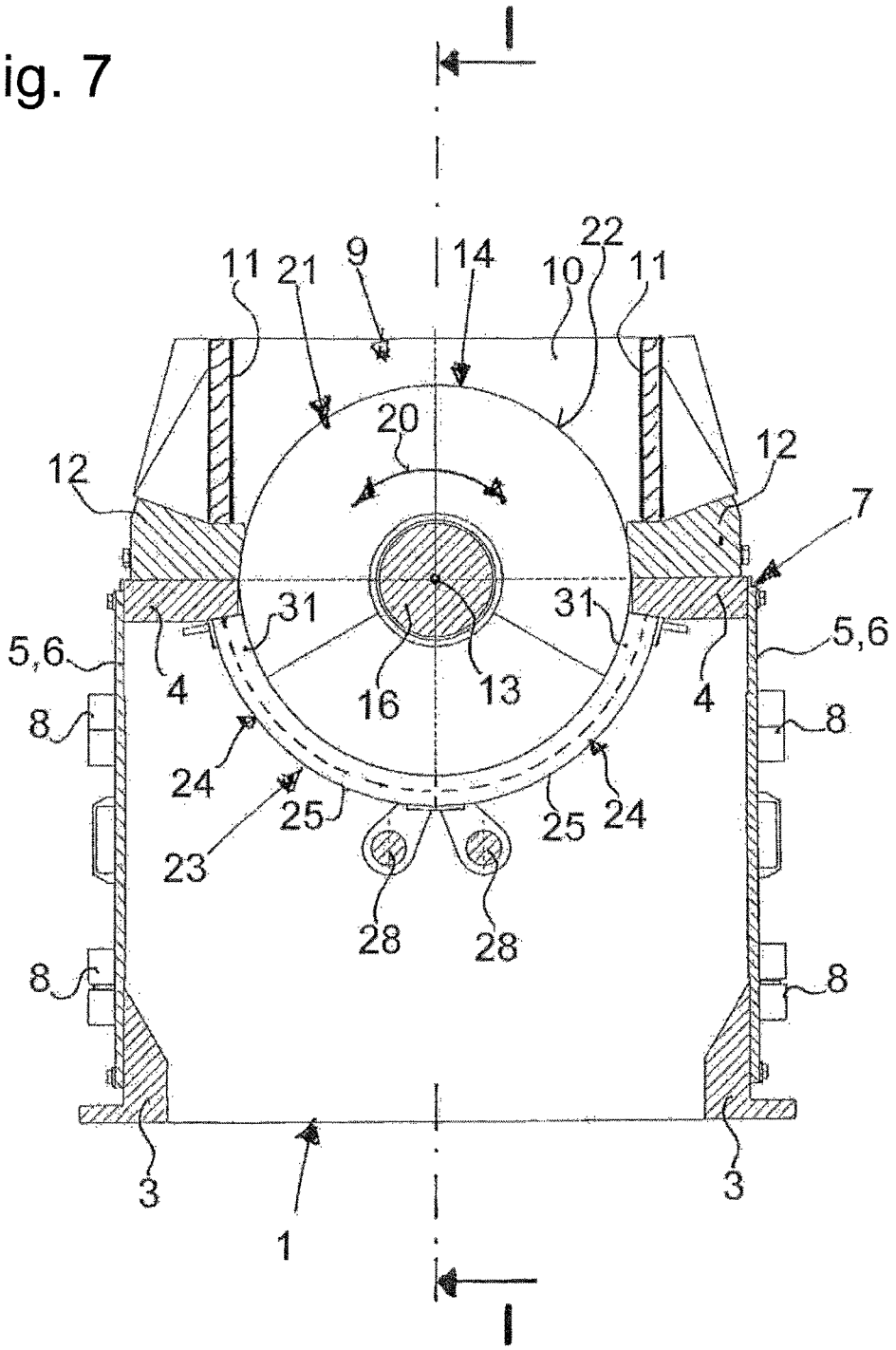
FIG. 7 is a cross section through the device depicted in FIG. 1 along the line II-II according to another embodiment.

Screen deck 23 comprising screen support 25 with perforated screen 26 mounted thereupon can be seen lying radially opposite to rotor 14. An arc-shaped sealing element 31 is attached to the outer side, opposite to cross wall 2, of screen support 25; it extends over the entire circumferential length of screen element 24 and thereby forms a radial projection W over the inner circumference of perforated screen 26 with its inner circumference. Sealing element 31 can be formed in this case of one, two, three, or more arc sections. In the present exemplary embodiment, sealing element 31 is mounted axially to the screen support by means of screws. This has the advantage that sealing elements 31 can be exchanged and replaced by others for retrofitting of the device. Embodiments with sealing elements 31 formed monolithically on screen support 25 as shown in FIG. 7 also fall within the scope of the invention, however, which reduces the on-site assembly costs.

In addition, sealing element 31 lies opposite to ring disc 21 with the formation of a sealing gap at a narrow radial distance. The radial width of the sealing gap is designated with $S_1$ and is, for example, between 0.5 mm and 1.5 mm, preferably 1 mm. The radial projection of sealing element 31 over perforated screen 26 causes an accumulation of particles passing the sealing gap, with the effect that the gap passage occurs with a delay.

The variant illustrated in FIG. 4 differs from this embodiment in a relative position of the sealing gap in the radial direction at the level of perforated screen 26. The sealing gap therefore aligns with the inner circumference of perforated screen 26, which facilitates gap passage primarily for fiber-containing feedstock or wires. The radial width of the sealing gap is again designated by $S_1$ and is, for example, between 0.5 mm and 1.5 mm, preferably 1 mm. The radial maximum distance $A_2$ of rotor tools 19 from perforated screen 26 in this case is, for example, 5 mm to 15 mm.

Figure 5:
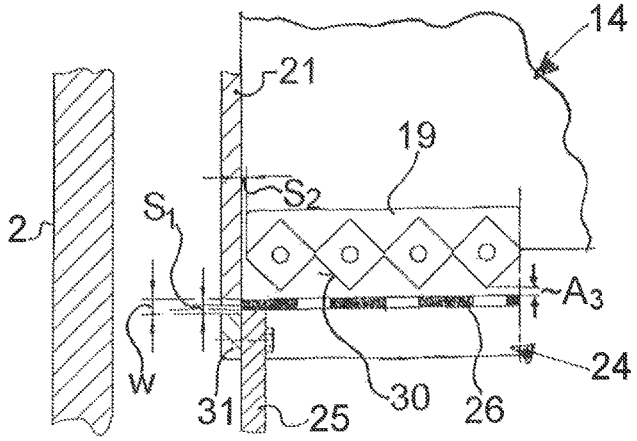
FIG. 5 illustrates a second alternative embodiment of the area labeled with D in FIG. 1.

In the embodiment shown in FIG. 5, the sealing gap is offset radially outward compared with embodiment described in FIG. 4, whereby the rotor-side ring disc 21 overlaps with the front side of perforated screen 26 radially by the amount W. In the overlap region between ring discs 21 and perforated screen 26, a second radially directed sealing gap is formed, which coincides with a termination point of the first axially directed sealing gap. Preferably, the second sealing gap has a smaller width than the first sealing gap, in order to prevent clogging of the sealing gap. In the present example, the width S2 of the second sealing gap is a maximum of 0.5 mm and the width S1 of the first sealing gap is a maximum of 1 mm. The radial maximum distance A3 of rotor tools 19 from perforated screen 26 is, for example, 0.5 mm to 5 mm.

FIG. 6 shows finally an embodiment of the invention in which the sealing gap between ring disc 21 and sealing element 31 does not run axially but at the angle $\alpha$ to longitudinal axis 13. The sealing gap has an inner gap opening 32, facing perforated screen 26, and an outer gap opening 33, facing away from perforated screen 26, whereby inner gap opening 32 connects flush to the inner circumference of perforated screen 26 and outer gap opening 33, in contrast, is offset radially inward toward longitudinal axis 13. This results in a gap course which is oriented obliquely to longitudinal axis 13 and in which the material penetrating the gap along pathway 34 is subjected to a jamming effect. The gap width is again between 0.5 mm and 1 mm. The angle $\alpha$ is 15° to 45°.

The invention is not limited to the combination of features described in the individual exemplary embodiments, but likewise comprises combinations of features of different exemplary embodiments, provided these are readily discernible by the person skilled in the art.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A device for comminuting feedstock, the device comprising:

a rotor disposed in a housing, the rotor rotates about an axis of rotation and has comminuting tools over a circumference of the rotor;

a ring disc attached on a first side of the rotor concentrically to the axis of rotation, the ring disc having an outer edge surface, an inner surface that faces in an axially inward direction, and an outer surface that faces in an axially outward direction;

at least one screen deck extending over part of the circumference of the rotor; and an arcuate sealing element, following the circumference of the ring disc relative to a radial direction of the rotor, is disposed on a side of the screen deck that faces the ring disc, the sealing element being disposed at the same axial position in the axial direction as an axial position of the ring disc, a sealing gap being formed between the ring disc and the sealing element, the sealing element having an inner edge surface, an outer edge surface, an inner surface that faces in an axially inward direction, and an outer surface that faces in an axially outward direction, wherein the screen deck has a screen support and a perforated screen, an axial end of the perforated screen disposed on a radially inward side of the screen support, wherein the axial end of the perforated screen does not overlap with the sealing element in the axial direction, and wherein the sealing element is releasably attached to the screen support by a fastener by penetrating through the sealing element and the screen support in a direction parallel to the axial direction, the sealing element being at an axially outward position relative to the screen support, wherein the sealing element has a semi annular shape with the inner and outer edge surfaces defining inner and outer radial sides of the semi annular shape, and wherein the inner surface of the ring disc is aligned with the inner surface of the sealing element, and the outer surface of the ring disc is aligned with the outer surface of the sealing element in the radial direction.

2. The device according to claim 1, wherein an inner circumference of the sealing element aligns in the axial direction with an inner circumference of the perforated screen.

3. The device according to claim 1, wherein an inner circumference of the sealing element is disposed at a radially inward position that is closer to the axis of rotation of the rotor than a radial position of an inner circumference of the perforated screen.

4. The device according to claim 1, wherein an inner circumference of the sealing element is disposed at a radially outward position that is farther from the axis of rotation of the rotor than a radial position of an inner circumference of the perforated screen.

5. The device according to claim 4, wherein the sealing gap is a first sealing gap, the ring disc and the perforated screen overlap in the radial direction, and a second sealing gap is radially formed between the ring disc and the comminuting tools.

6. The device according to claim 5, wherein a width of the second sealing gap is smaller than a width of the first sealing gap.

7. The device according to claim 5, wherein the first sealing gap is blocked by the perforated screen, and the second sealing gap radially extends at an axial position that corresponds to a terminated position of the first sealing gap.

8. The device according to claim 1, wherein the sealing gap has an inner gap opening facing the perforated screen and an outer gap opening facing away from the perforated screen, and wherein the inner gap opening and outer gap opening align in the axial direction.

9. The device according to claim 1, wherein the sealing gap has an inner gap opening facing the perforated screen and an outer gap opening facing away from the perforated screen, and wherein the outer gap opening is disposed at a radially inward position that is closer to the axis of rotation of the rotor than a radial position of the inner gap opening.

10. The device according to claim 1, wherein the sealing gap has an inner gap opening facing the perforated screen and an outer gap opening facing away from the perforated screen, and wherein the outer gap opening is disposed at a radially inward position that is closer to the axis of rotation of the rotor than a radial position of the inner gap opening.

11. The device according to claim 1, wherein the sealing element is attached to the screen support.

12. The device according to claim 1, wherein the ring disc is formed from at least two ring disc sectors or three ring disc sectors.

13. The device according to claim 1, wherein the housing includes a wall parallel to a surface of the ring disc in the axial direction of the rotor, and the wall is spatially separated from the surface of the ring disc in the axial direction of the rotor by a predetermined distance.

14. The device according to claim 13, wherein the predetermined distance is 3 cm or more and 5 cm or less.

15. The device according to claim 1, wherein the sealing gap extends and is orientated obliquely to the axis of rotation of the ring disc and the sealing element.

* * * * *